US007587788B2

(12) United States Patent
Heid

(10) Patent No.: US 7,587,788 B2
(45) **Date of Patent: *Sep. 15, 2009**

(54) HORIZONTALLY ADJUSTABLE HINGE

(75) Inventor: George E. Heid, Rockford, IL (US)

(73) Assignee: Newell Operating Company, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/032,945

(22) Filed: Feb. 18, 2008

(65) Prior Publication Data

US 2008/0148516 A1 Jun. 26, 2008

Related U.S. Application Data

(63) Continuation of application No. 11/084,262, filed on Feb. 25, 2005, now Pat. No. 7,331,085.

(60) Provisional application No. 60/548,845, filed on Feb. 27, 2004, provisional application No. 60/555,223, filed on Mar. 22, 2004.

(51) Int. Cl.
*E05D 7/04* (2006.01)

(52) U.S. Cl. ..... 16/242; 16/245

(58) Field of Classification Search ..... 16/243–245, 16/248, 299–301, 236–238, 257, 259, 271, 16/241, 242, 258, 264
See application file for complete search history.

(56) References Cited

U.S. PATENT DOCUMENTS 375,038 A 12/1887 Wright
375,039 A 12/1887 Wright
386,186 A 7/1888 Dahlman
442,547 A 12/1890 Radler
794,454 A 7/1905 Davis et al.
843,081 A 2/1907 Fitgerald
863,128 A 8/1907 Aebi
880,317 A 2/1908 Ven De Marwitz
928,760 A 7/1909 Hunter
1,002,394 A 9/1911 Hanson
1,111,832 A 9/1914 Hazelrigg et al.
1,214,263 A 1/1917 Barber
1,314,732 A 9/1919 Cochran et al.
1,341,063 A 5/1920 McQueen
2,373,955 A 4/1945 Fuller
2,474,311 A 6/1949 Graham
2,506,619 A * 5/1950 Schwartz ..... 305/152
2,588,258 A 3/1952 Lowman
2,683,279 A 7/1954 Okerlund et al.
2,913,200 A 11/1959 Paine, Jr. et al.
2,940,115 A 6/1960 Hansen
3,423,786 A 1/1969 Arias, Jr. et al.
3,475,784 A 11/1969 Foltx (Continued)

*Primary Examiner*—Chuck Y. Mah
(74) *Attorney, Agent, or Firm*—Banner & Witcoff, Ltd

(57) ABSTRACT

A horizontally adjustable hinge is disclosed. The hinge comprises a base member having a slot and a channel generally perpendicular to the slot, an adjustment nut disposed in the channel, the adjustment nut having a generally circumferential recess and a threaded axial bore, the adjustment nut being rotationally fixed within the channel, a screw threadably engaged in the threaded axial bore and axially fixed relative to the base member and a leaf for insertion into the slot. The leaf has a slot dimensioned to receive the circumferential recess, wherein rotation of the screw moves the adjustment nut axially in the channel, thereby moving the leaf in the slot.

24 Claims, 15 Drawing Sheets

U.S. PATENT DOCUMENTS 3,584,332 A * 6/1971 Taylor ..... 16/245
3,613,150 A 10/1971 Osborn
3,618,993 A 11/1971 Platte
4,106,158 A 8/1978 Kellems et al.
4,141,109 A 2/1979 Farrell
4,142,272 A 3/1979 Oogami et al.
4,143,846 A * 3/1979 Rock et al. ..... 248/692
4,304,027 A 12/1981 DiFazio
4,330,901 A 5/1982 Sanders
4,386,646 A 6/1983 Maryas
4,434,523 A 3/1984 Grass
4,493,129 A 1/1985 Grass
4,571,774 A 2/1986 Hinson
4,590,642 A 5/1986 Hesener
4,639,971 A 2/1987 Kurtz
4,658,470 A * 4/1987 Oen ..... 16/241
4,783,879 A * 11/1988 Weaver ..... 16/34
5,067,056 A * 11/1991 Suzuki et al. ..... 362/462
5,158,333 A * 10/1992 Saville ..... 296/76
5,339,493 A * 8/1994 MacIntyre ..... 16/238
5,713,105 A 2/1998 Toomey
5,755,011 A * 5/1998 Green et al. ..... 16/238
5,799,370 A * 9/1998 Davidian et al. ..... 16/236
6,516,494 B2 * 2/2003 Nakamoto et al. ..... 16/271
6,715,181 B1 4/2004 Fries
7,331,085 B2 2/2008 Heid
7,334,293 B2 2/2008 Erickson et al.
2005/0188500 A1 9/2005 Heid
2006/0179610 A1 8/2006 Erickson et al.

* cited by examiner

HORIZONTALLY ADJUSTABLE HINGE

CROSS-REFERENCE TO RELATED APPLICATIONS

The present application is a continuation of U.S. patent application Ser. No. 11/084,262 (filed Feb. 25, 2005), issued as U.S. Pat. No. 7,331,085 (issued on Feb. 19, 2008), and claims the benefit thereof, which claims the benefit of provisional patent application No. 60/548,845, filed in the United States Patent and Trademark Office on Feb. 27, 2004, and provisional patent application No. 60/555,223, filed in the United States Patent and Trademark Office on Mar. 22, 2004.

FEDERALLY SPONSORED RESEARCH OR DEVELOPMENT

Not Applicable.

TECHNICAL FIELD

This invention relates to an adjustable hinge system, such as for a door.

BACKGROUND OF THE INVENTION

Adjustable hinges are desirable, as they permit adjustment as needed such as when a house settles. Typically such adjustable hinges have been complicated and have required multiple fastening components.

DETAILED DESCRIPTION OF A PREFERRED EMBODIMENT

Figure 1:
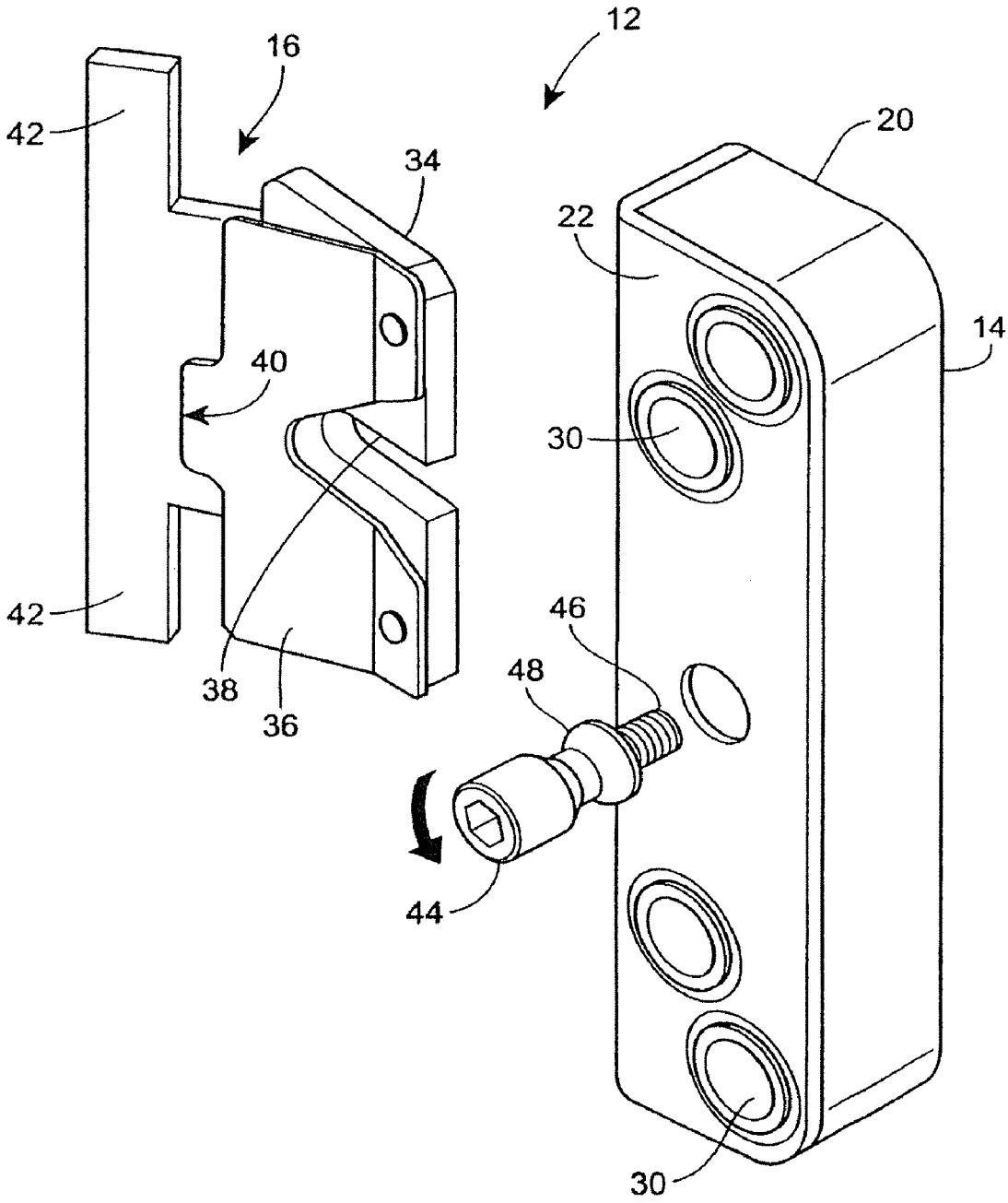
FIG. 1 is a perspective view of one embodiment of an adjustable hinge of the present invention.
Figure 2:
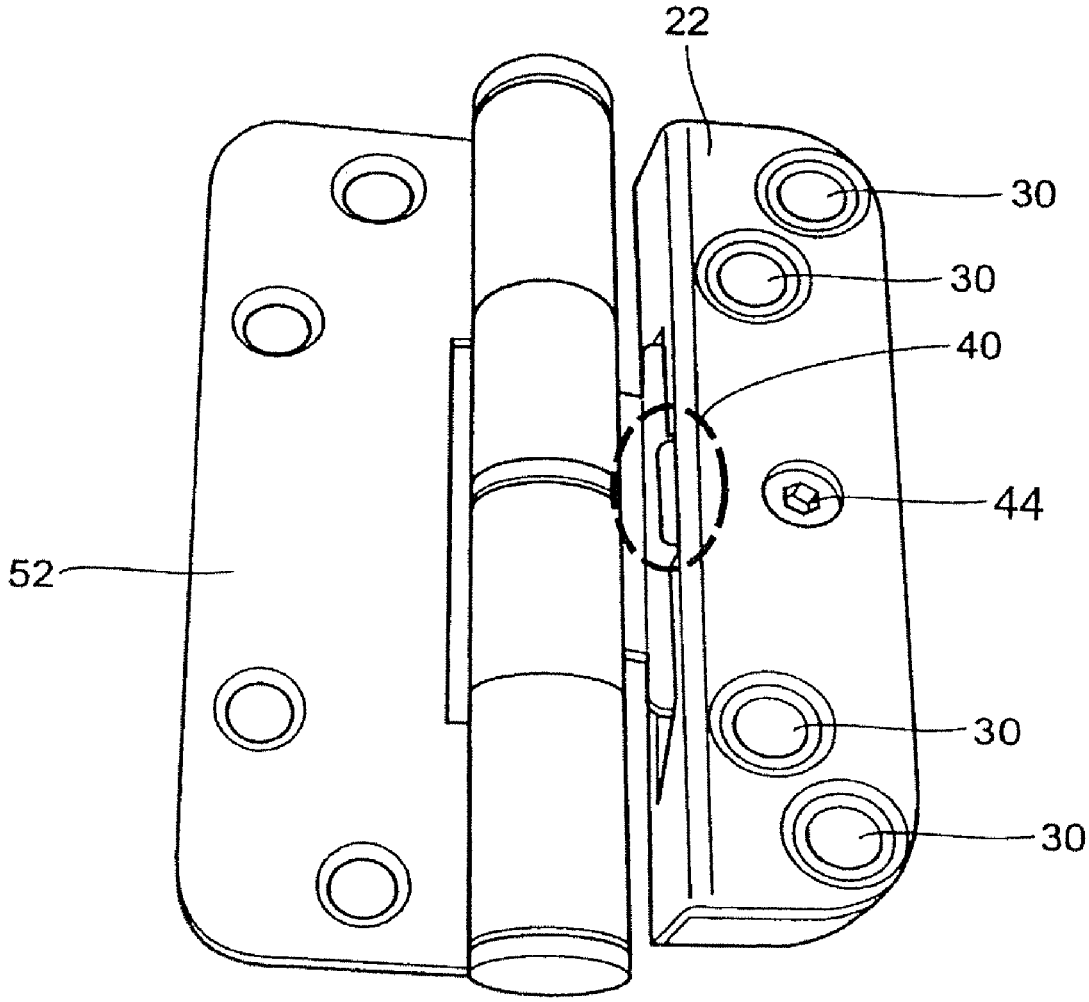
FIG. 2 is a front view of the adjustable hinge of FIG. 1.
Figure 3:
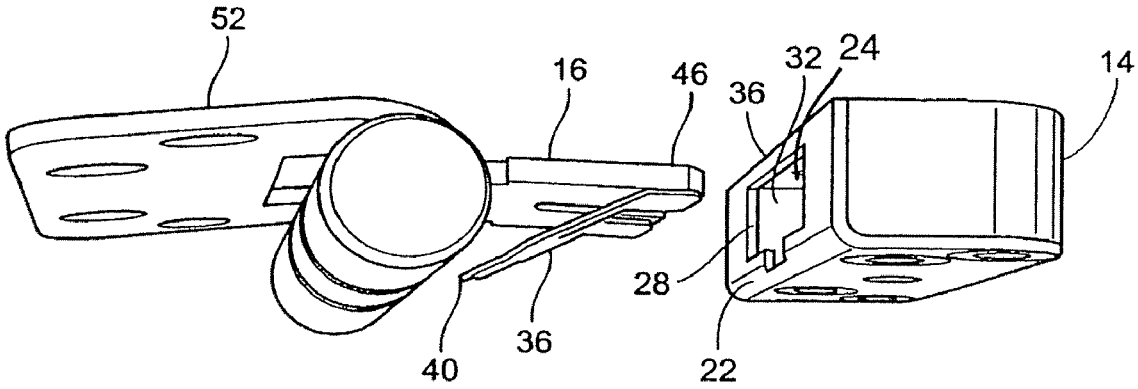
FIG. 3 is a generally top view of the hinge of FIG. 1.
Figure 4:
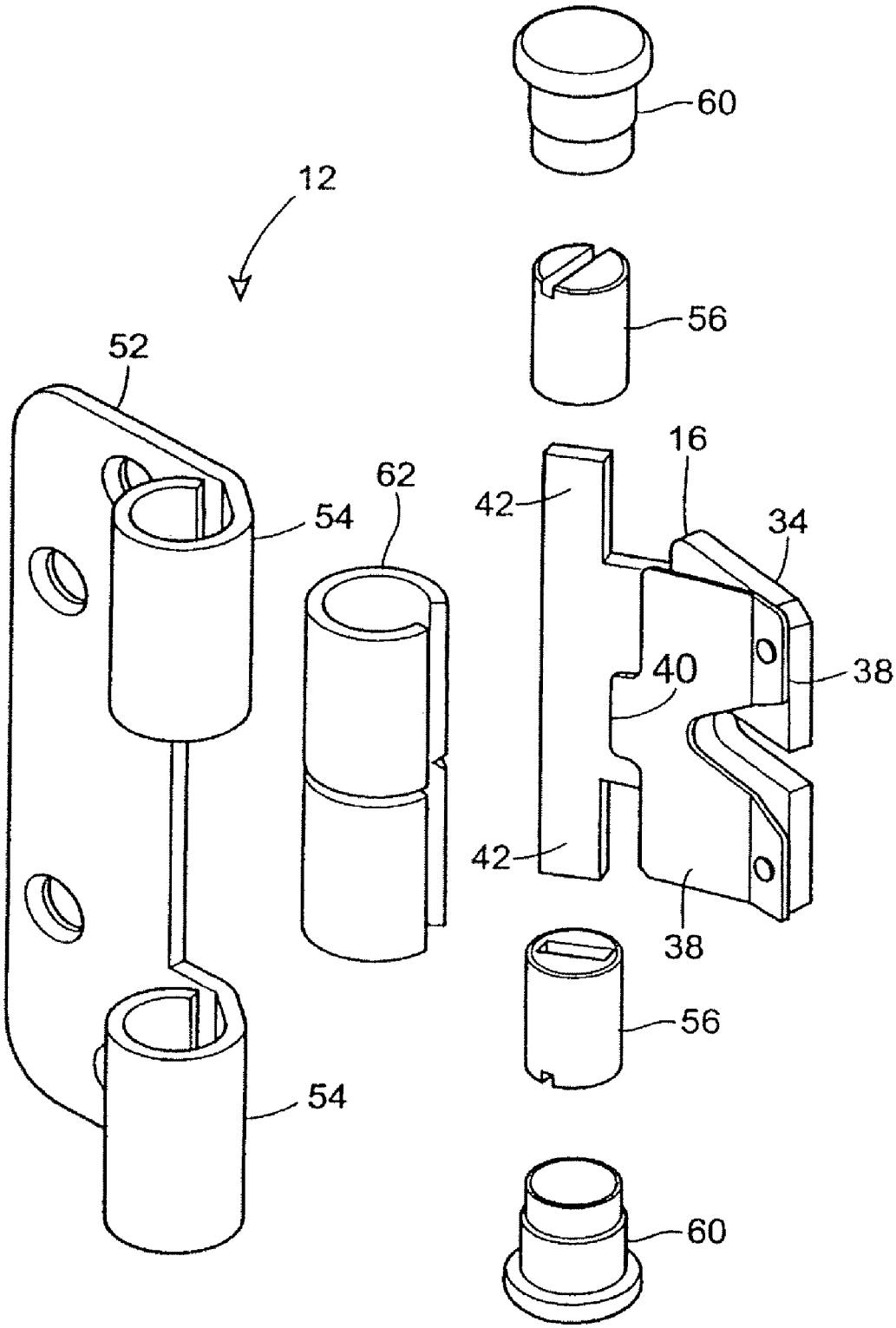
FIG. 4 is an exploded view of the hinge of FIG. 1, which hinge is not vertically adjustable.
Figure 5:
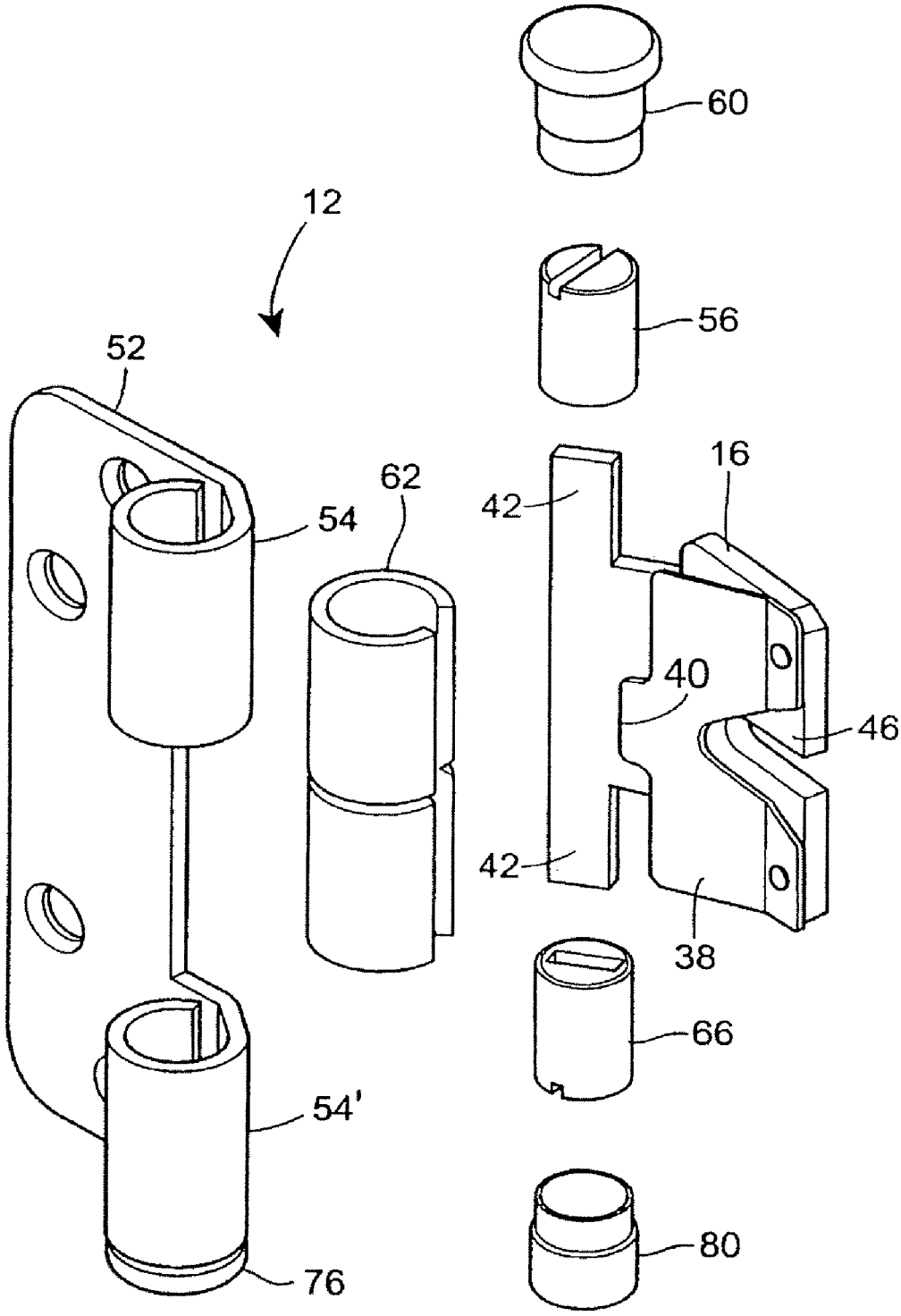
FIG. 5 is an exploded view of a the hinge of FIG. 1, which hinge is vertically adjustable.
Figure 6:
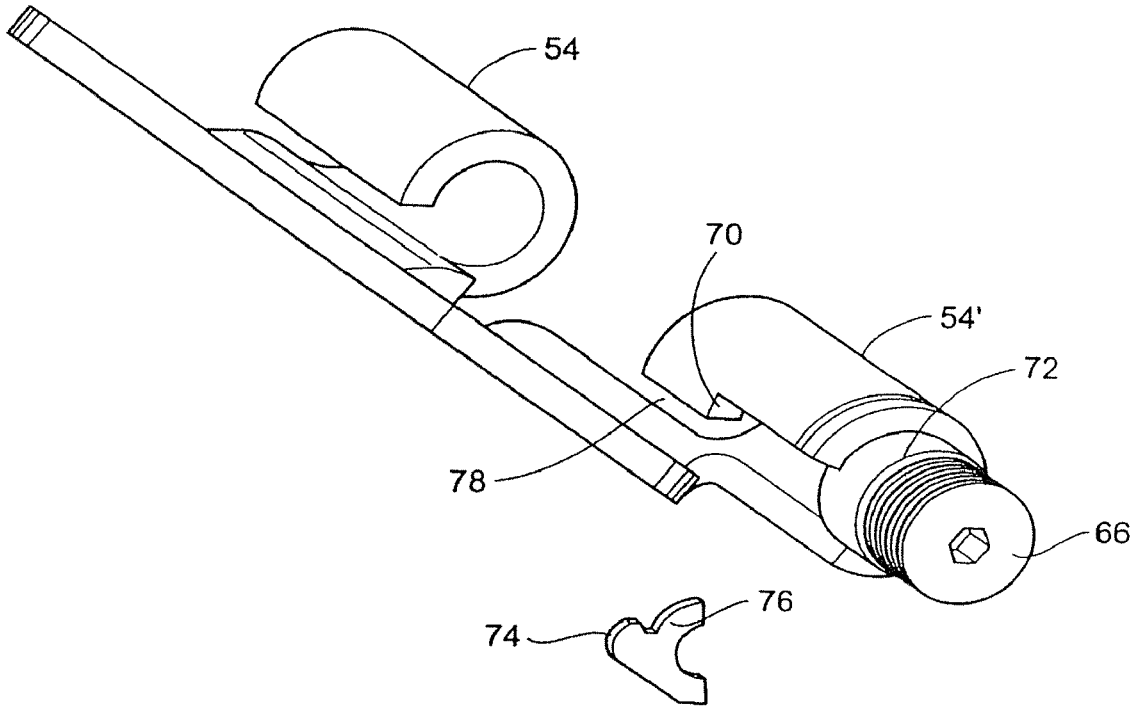
FIG. 6 is a perspective view of a frame wing of the vertically adjustable hinge of FIG. 5.
Figure 7:
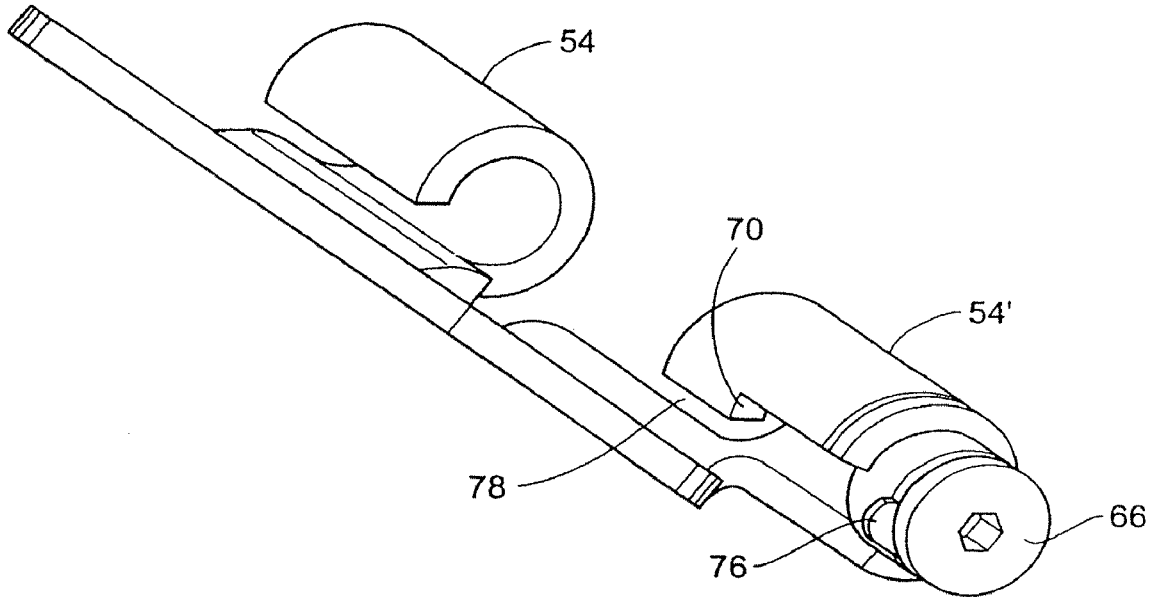
FIG. 7 is a further perspective view of a frame wing of the vertically adjustable hinge of FIG. 5.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A first embodiment of a horizontally adjustable hinge 12 is illustrated in FIGS. 1-4. The hinge 12 includes a receiver assembly 14 and a steel door leaf 16. The receiver assembly 14 includes a die cast housing 20 and a steel or brass cover 22. The housing 20 has a tapered slot 24 extending from a housing opening 26. The cover 22 has a slotted opening 28 aligned with, but slightly smaller than, the housing opening 32. The receiver assembly 14 includes four aligned holes 30 to receive screws (hot shown) to secure the receiver assembly 14 to a door (not shown).

The door leaf 16 includes a slotted leaf 34 and a retaining spring 36. The retaining spring 36 is attached to, and extends from, the slotted leaf 34. The slotted leaf 34 has a leaf slot 38. The retaining spring 36 terminates with a release tab 40. The door leaf 20 further includes first and second opposed posts 42.

The slotted leaf 34 is inserted into the tapered housing slot 24. As the slotted leaf 34 is inserted, the retaining spring 36 is squeezed by the cover opening 28, until the spring 36 passes the cover opening 28, at which time the spring 36 expands, locking the slotted leaf 34 in the tapered slot 24. The slotted leaf 34 can be removed by depressing the tab 40, such as with a screw driver.

The hinge 12 includes an adjustment screw 44. The adjustment screw 44 includes a threaded portion 46 and a circumferential grooved portion 48. The threaded portion 46 is screwed into a cooperatively threaded hole 50 in the housing 20.

As the slotted leaf 34 is inserted into the tapered housing slot 24, the leaf slot 38 captures the grooved portion 48 of the adjustment screw 44. Rotation of the adjustment screw 44, such as with an Allen wrench, axially moves the adjustment screw 44, thereby horizontally moving the door leaf 16.

The hinge 12 further includes a steel frame wing 52 for attachment to a door frame (not shown). The frame wing 52 includes first and second opposed knuckles 54. Bearings 56 are placed over the first and second posts 42, which are then placed into respective first and second knuckles 54. Decorative steel end caps 60 are placed over outer openings of the knuckles 54. A decorative steel shroud 62 is disposed between the knuckles 54.

The hinge 12 can also be vertically adjustable, as illustrated in FIGS. 5-8.

To make the hinge 12 vertically adjustable, the bottom one of the knuckles 54' is internally threaded to receive an externally threaded vertical positioning screw 66. Rotation of the vertical positioning screw 66 vertically adjusts the door leaf 34 relative to the frame wing 52. The decorative end cap 60 is placed over the opening of the other knuckle 54. Which knuckle is threaded depends upon whether the hinge is to be a right hand hinge or a left hand hinge.

Such vertical adjustment systems are known, but have been subject to a problem of having the vertical positioning screw 66 lock when it is rotated past the threads of the threaded knuckle 54'.

Figure 8:
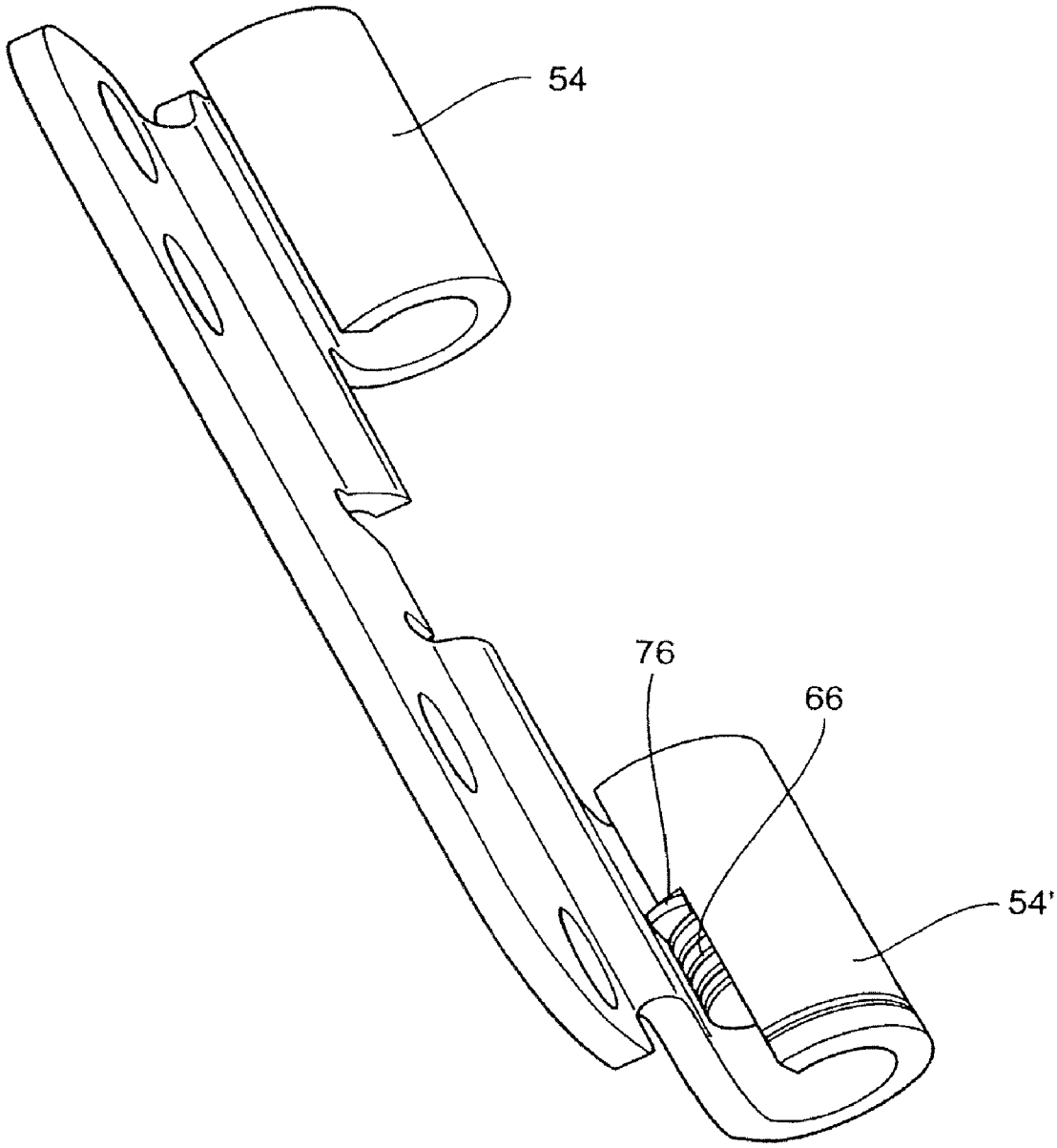
FIG. 8 is a further perspective view of a frame wing of the vertically adjustable hinge of FIG. 5.
Figure 9:
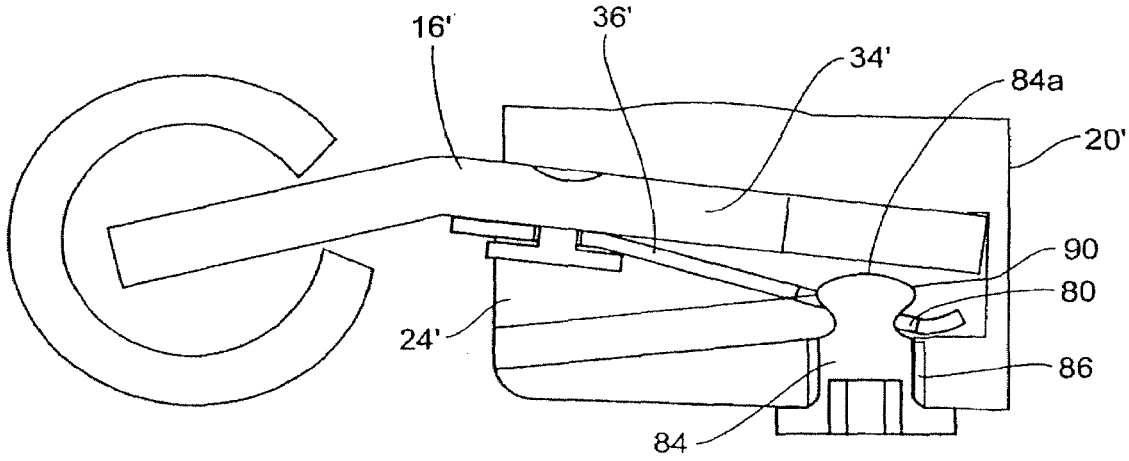
FIG. 9 is a sectional view of a hinge having an alternative arrangement for securing the door leaf to the housing.
Figure 10:
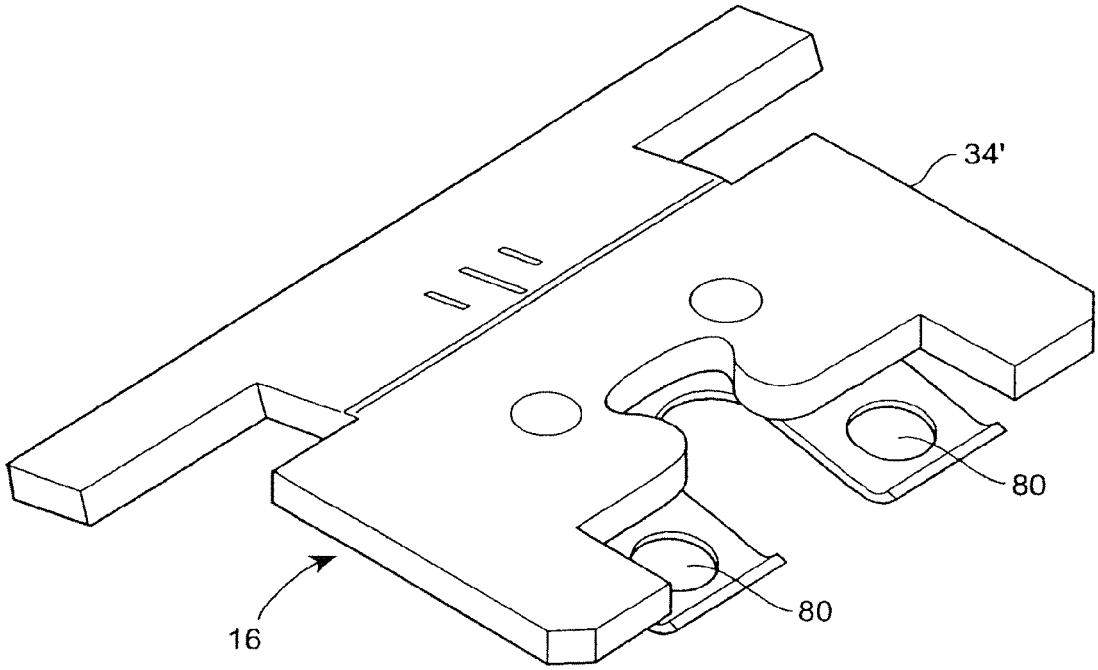
FIG. 10 is a perspective view of a door leaf of the embodiment of FIG. 9.

In accordance with this aspect of the invention, the threaded knuckle 54' is provided with a stop surface 70. The vertical positioning screw 66 includes a circumferential groove 72, which receives a wing stop 74. The wing stop 74 is preferably formed of steel, and includes a stop tab 76. As the vertical positioning screw 66 is rotated into the threaded knuckle 54', the stop tab 76 travels along a knuckle slot 78, until the stop tab 76 ultimately engages, and is blocked by, the stop surface 70, as illustrated in FIG. 8.

Figure 11:
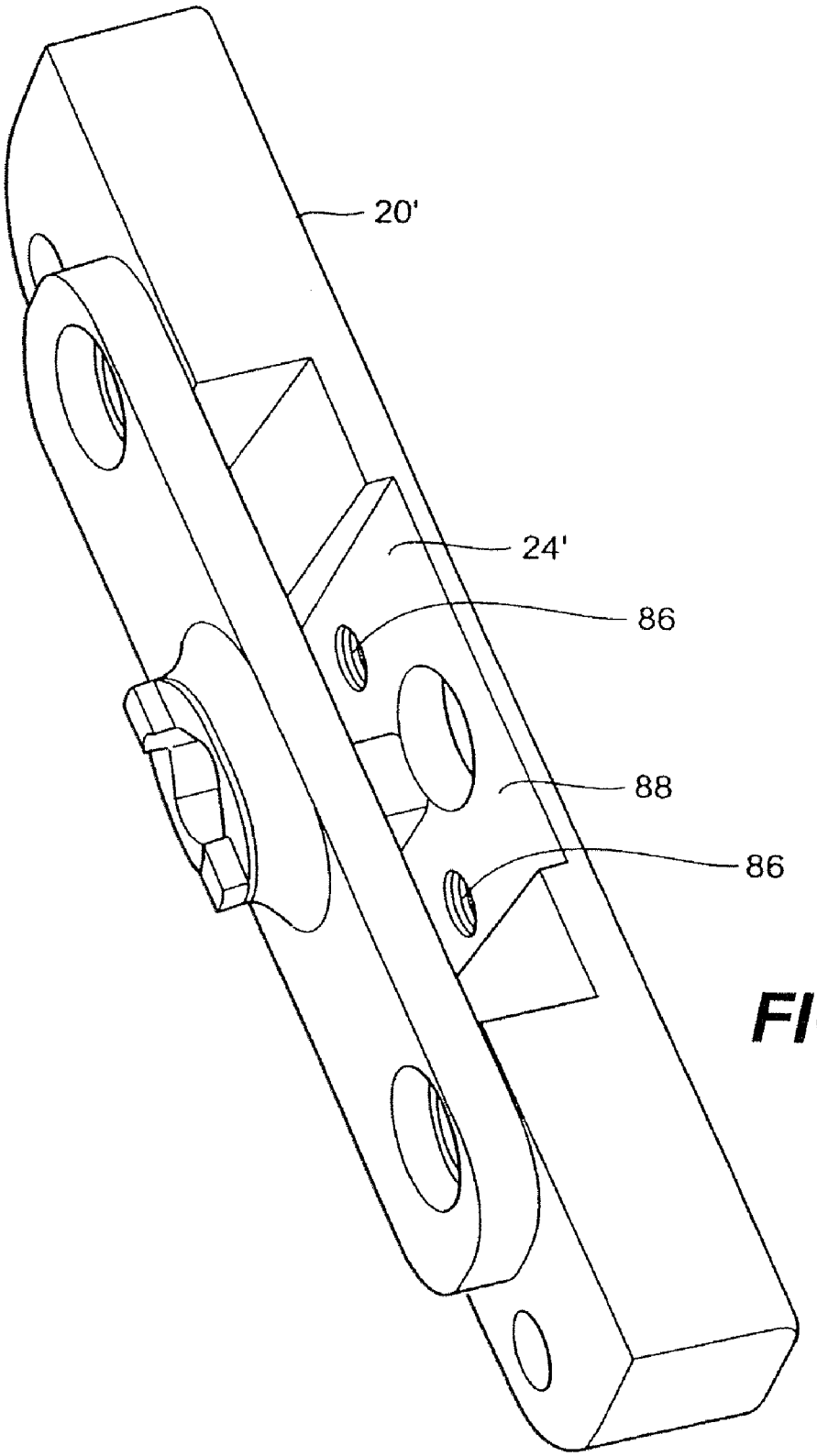
FIG. 11 is a perspective view of a spring pocket of the embodiment of FIG. 9.
Figure 12:
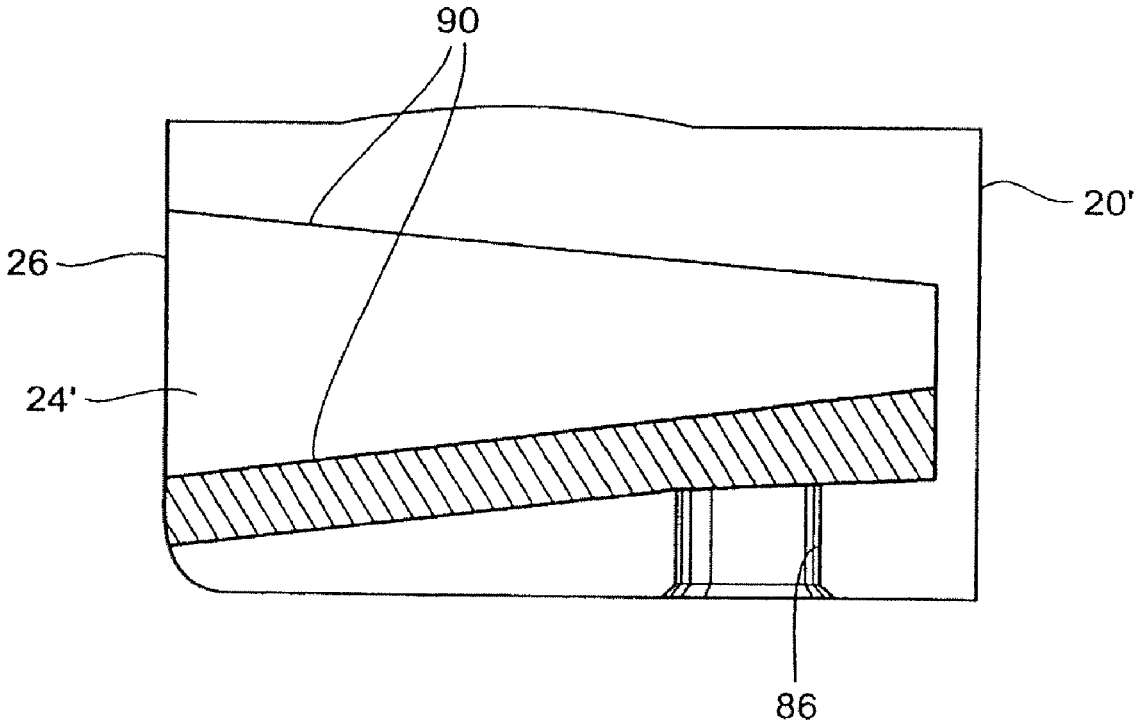
FIG. 12 is a sectional view of a spring pocket of the embodiment of FIG. 9.

A second embodiment of a system for retaining a door leaf 16' in a modified housing 20', using a modified retaining spring 36", having spring apertures 80, is illustrated in FIGS. 9-12. As discussed below, other changes include two threaded release pins 84 for insertion in corresponding threaded passages 86 in the housing 20'. In addition, a modified tapered slot 24' includes a pocket 88 along opposed walls 90 of the modified tapered slot 24'. The pocket 88 is best seen in FIGS. 11 and 12.

As the retaining spring 36' is inserted into the tapered slot 24', a distal portion of the spring 36' passes over tips 84*a* of the release pins 84, until the tips 84*a* of the release pins 84 extend into the spring apertures 80, locking the slotted leaf 34' in the housing 20'. In order to subsequently remove the slotted leaf 34' from the housing 20', the release pins 84 are first unthreaded from the housing 20', and the slotted leaf 34' is slid out of the tapered slot 24'.

As best seen in FIGS. 11 and 12, the tapered slot 24' includes the pocket 88, dimensioned to receive the spring 36' when the slotted leaf 34' is drawn towards the wall 90, providing precise horizontal positioning of the slotted leaf 34.

A second embodiment of a horizontal hinge adjustment system for an adjustable hinge 12' is illustrated in FIGS. 13-16. The adjustable hinge 12' includes a receiver assembly 14', a stop plate 92 and a cover 22', collectively to be mounted to a door (not shown). The adjustable hinge 12' further includes a slotted leaf 34. The slotted leaf may be either of the above-described slotted leafs.

The hinge 12' includes a horizontal adjustment screw 94, preferably formed of stainless steel. The horizontal adjustment screw 94 is threaded into a threaded passage of a horizontal adjustment nut 96. The horizontal adjustment nut 96 is preferably formed of steel. As the horizontal adjustment screw 94 is rotated, the horizontal adjustment nut 96 moves axially along the horizontal adjustment screw 94. The horizontal adjustment nut 96 has a generally squared portion 96*a*, which fits into a complementarily shaped portion 14*a* in the receiver assembly 14', to prevent rotation of the horizontal adjustment nut 96.

The horizontal adjustment nut 96 includes a circumferential grooved portion 46 to receive the leaf slot 38' in the door leaf 34.

Figure 13:
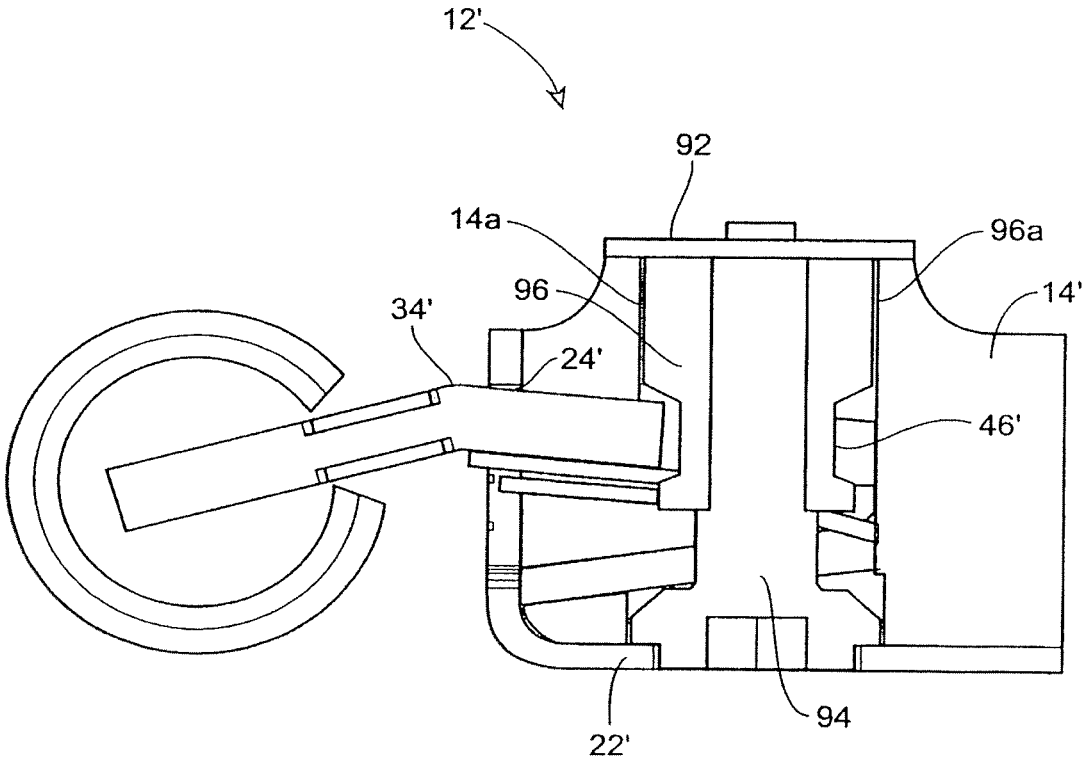
FIG. 13 is a sectional view of a hinge having an alternative arrangement for horizontally adjusting the hinge.
Figure 14:
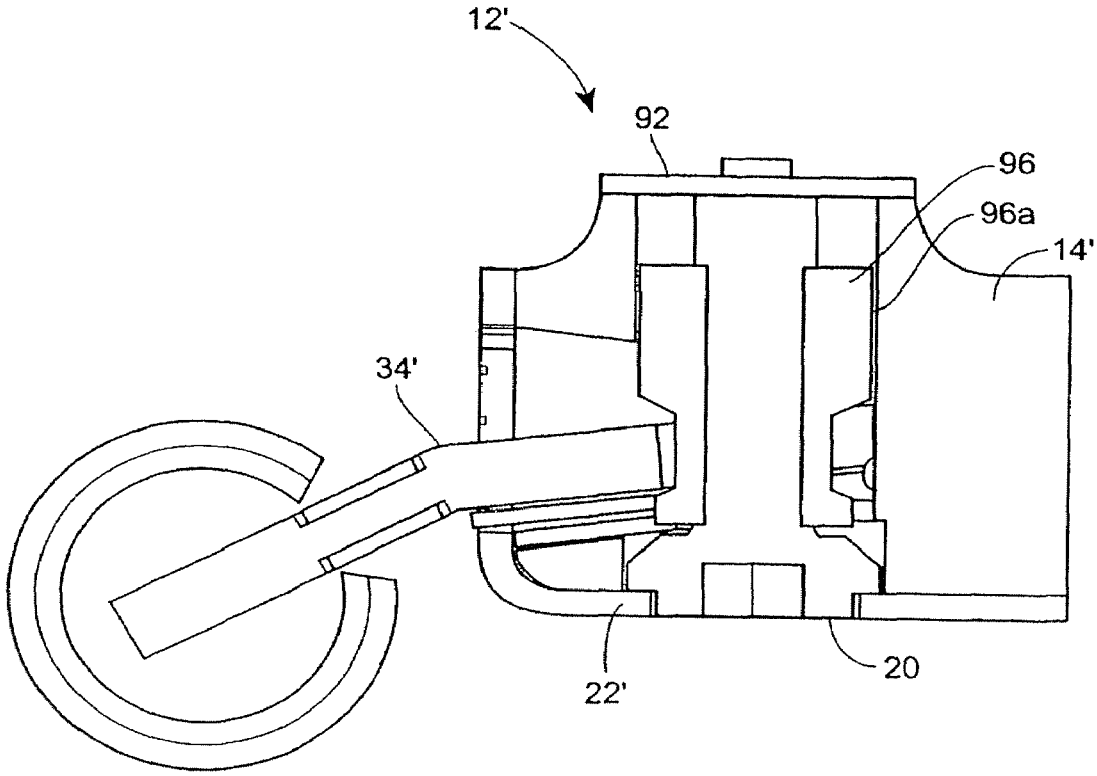
FIG. 14 is a further sectional view of the embodiment of FIG. 13.
Figure 15:
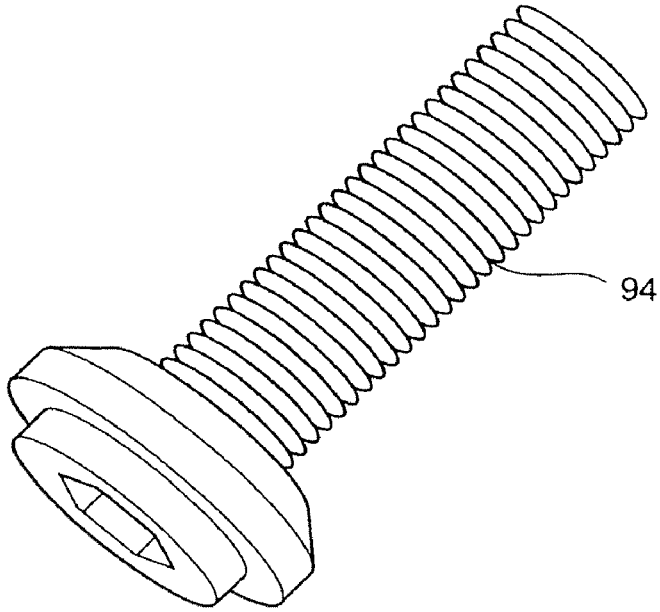
FIG. 15 is a perspective view of an adjustment screw as used in the embodiment of FIG. 13.
Figure 16:
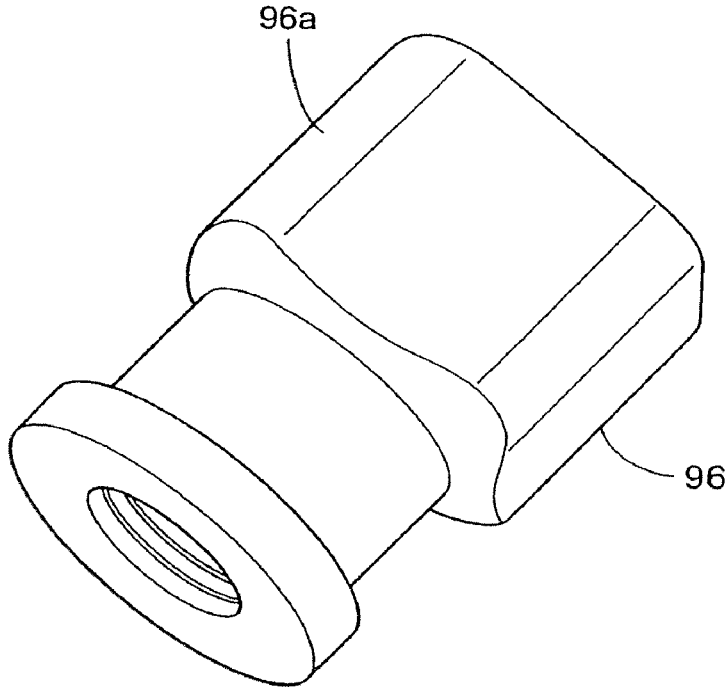
FIG. 16 is a perspective view of an adjustment nut as used in the embodiment of FIG. 13.

Rotation of the horizontal adjustment screw 94 in a first direction moves the door leaf 34' to a first horizontal position, as shown in FIG. 13. Rotation of the horizontal adjustment screw 94 in a second, opposite direction moves the door leaf 34' to a second horizontal position, as shown in FIG. 14.

The groove in the adjustment nut and the slot of the slotted leaf are sized to minimize play between the components during adjustment. The centerline of the slot of the slotted leaf and the centerline of the adjustment nut will be coincident in the nominal position.

The horizontal positioning feature and the vertical positioning feature can be implemented in a single hinge. Alternatively, a hinge may include only one of the features. It is believed to be more desirable to the end consumer to utilize, in a three hinge system, horizontally adjustable hinges as the upper and lower hinges, and a vertically adjustable hinge as the center hinge.

If a hinge only includes the vertical adjustment feature, no horizontal adjustment screws are required. To cover the opening for the adjustment screw, a cover solid at that location can be provided.

What is claimed is:

1. An assembly comprising:

a base member having an opening and a base slot extending in an inward direction from the opening, the base slot adapted to receive insertion of a leaf therein such that the leaf extends from outside the base member through the opening and into the base slot in the inward direction;

an adjustment nut positioned at least partially within the base slot, the adjustment nut having a threaded axial bore, wherein the adjustment nut is adapted to engage the leaf when the leaf is received in the base slot; and a screw extending generally perpendicular to the inward direction of the base slot and threadably engaged in the threaded axial bore, wherein rotation of the screw moves the adjustment nut axially along an axis generally perpendicular to the inward direction of the base slot, and wherein movement of the adjustment nut is adapted to move the leaf within the base slot.

2. The assembly of claim 1, further comprising the leaf, wherein the leaf is received in the base slot and the adjustment nut engages the leaf, and wherein movement of the adjustment nut moves the leaf within the base slot.

3. The assembly of claim 2, wherein the leaf comprises a leaf slot, and wherein at least a portion of the adjustment nut is received in the leaf slot when the leaf is received in the base slot.

4. The assembly of claim 3, wherein the adjustment nut has a generally circumferential recess, and wherein the recess is received in the leaf slot when the leaf is received in the base slot.

5. The assembly of claim 1, wherein the adjustment nut has a generally circumferential recess, and wherein the recess is adapted to receive a portion of the leaf when the leaf is received in the base slot.

6. The assembly of claim 1, wherein the base further comprises a channel generally perpendicular to the inward direction of the base slot, and wherein the adjustment nut is disposed in the channel.

7. The assembly of claim 6, wherein the channel and the adjustment nut have engaging surfaces cooperatively shaped to prevent the rotation of the adjustment nut within the channel.

8. The assembly of claim 7, wherein the channel and a portion of the adjustment nut are generally square to form the cooperatively shaped engaging surfaces.

9. An assembly comprising:

a base member having a base slot adapted to receive a leaf therein;

an adjustment nut positioned at least partially within the base slot, the adjustment nut having a recess and threaded axial bore, wherein the recess of the adjustment nut is adapted to engage the leaf when the leaf is received in the base slot such that a portion of the leaf is received in the recess; and a screw extending threadably engaged in the threaded axial bore, wherein rotation of the screw moves the adjustment nut, and wherein movement of the adjustment nut is adapted to move the leaf within the base slot.

10. The assembly of claim 9, further comprising the leaf, wherein the leaf is received in the base slot and a portion of the leaf is received in the recess of the adjustment nut, and wherein movement of the adjustment nut moves the leaf within the base slot.

11. The assembly of claim 10, wherein the leaf comprises a leaf slot, and wherein the recess of the adjustment nut is received in the leaf slot when the leaf is received in the base slot.

12. The assembly of claim 9, wherein the recess of the adjustment nut is a generally circumferential recess.

13. The assembly of claim 9, wherein the recess of the adjustment nut extends around an entire periphery of the adjustment nut.

14. The assembly of claim 9, wherein rotation of the screw moves the adjustment nut along an axis generally perpendicular to the base slot.

15. The assembly of claim 9, wherein the base further comprises a channel generally perpendicular to the base slot, and wherein the adjustment nut is disposed in the channel.

16. The assembly of claim 15, wherein the channel and the adjustment nut have engaging surfaces cooperatively shaped to prevent the rotation of the adjustment nut within the channel.

17. The assembly of claim 16, wherein the channel and a portion of the adjustment nut are generally square to form the cooperatively shaped engaging surfaces.

18. A hinge assembly comprising:

a base member having a base slot therein;

a first leaf having a first portion inserted into the base slot and a second portion located external to the base member;

a second leaf pivotably connected to the second portion of the first leaf to form a hinge, the hinge having a pivot axis located external to the base member;

an adjustment nut positioned at least partially within the base slot, the adjustment nut having a threaded axial bore, wherein the adjustment nut engages the first leaf when the first leaf is inserted into the base slot; and a screw extending generally perpendicular to the pivot axis of the hinge, the screw being threadably engaged in the threaded axial bore, wherein rotation of the screw moves the adjustment nut axially along an axis generally perpendicular to the pivot axis of the hinge, thereby moving the leaf within the base slot.

19. The hinge assembly of claim 18, wherein the first leaf comprises a leaf slot, and wherein at least a portion of the adjustment nut is received in the leaf slot when the first leaf is received in the base slot.

20. The hinge assembly of claim 19, wherein the adjustment nut has a generally circumferential recess, and wherein the recess is received in the leaf slot when the first leaf is received in the base slot.

21. The hinge assembly of claim 18, wherein the adjustment nut has a generally circumferential recess, and wherein the recess receives a portion of the first leaf when the first leaf is received in the base slot.

22. The hinge assembly of claim 18, wherein the base further comprises a channel generally perpendicular to the pivot axis of the hinge, and wherein the adjustment nut is disposed in the channel.

23. The hinge assembly of claim 22, wherein the channel and the adjustment nut have engaging surfaces cooperatively shaped to prevent the rotation of the adjustment nut within the channel.

24. The hinge assembly of claim 23, wherein the channel and a portion of the adjustment nut are generally square to form the cooperatively shaped engaging surfaces.

* * * * *